US010749263B2

(12) United States Patent
Eberhardt et al.

(10) Patent No.: US 10,749,263 B2
(45) Date of Patent: Aug. 18, 2020

(54) PRINTED CIRCUIT BOARD MOUNTED ANTENNA AND WAVEGUIDE INTERFACE

(71) Applicant: Mimosa Networks, Inc., Santa Clara, CA (US)

(72) Inventors: Paul Eberhardt, Santa Cruz, CA (US); Syed Aon Mujtaba, Santa Clara, CA (US); Brian L. Hinman, Los Gatos, CA (US)

(73) Assignee: Mimosa Networks, Inc., Santa Clara, CA (US)

( * ) Notice: Subject to any disclaimer, the term of this patent is extended or adjusted under 35 U.S.C. 154(b) by 132 days.

(21) Appl. No.: 15/403,085

(22) Filed: Jan. 10, 2017

(65) Prior Publication Data

US 2017/0201028 A1 Jul. 13, 2017

Related U.S. Application Data

(60) Provisional application No. 62/277,448, filed on Jan. 11, 2016.

(51) Int. Cl.
*H01Q 13/06* (2006.01)
*H01Q 13/12* (2006.01)
(Continued)

(52) U.S. Cl.
CPC ..... *H01Q 13/12* (2013.01); *H01P 3/06* (2013.01); *H01P 3/127* (2013.01); *H01P 5/082* (2013.01);
(Continued)

(58) Field of Classification Search
CPC .. H01Q 9/0407; H01Q 9/0414; H01Q 9/0428; H01Q 9/0435; H01Q 9/0478;
(Continued)

(56) References Cited

U.S. PATENT DOCUMENTS 2,735,993 A 2/1956 Humphrey
3,182,129 A 5/1965 Clark et al.
(Continued)

FOREIGN PATENT DOCUMENTS

CN 104335654 A 2/2015
CN 303453662 S 11/2015
(Continued)

OTHER PUBLICATIONS

Weisstein, Eric "Electric Polarization", Retrieved from the Internet [retrieved Mar. 23, 2007] available at <http://scienceworld.wolfram.com/physics/ElectricPolarization.html>, 1 page.
(Continued)

*Primary Examiner* — Daniel Munoz
*Assistant Examiner* — Patrick R Holecek
(74) *Attorney, Agent, or Firm* — Carr & Ferrell LLP

(57) ABSTRACT

Printed circuit board mounted antenna and waveguide interfaces are provided herein. An example device includes any of a dielectric substrate or transmission line, an antenna mounted onto the dielectric substrate, and an elongated waveguide mounted onto the dielectric substrate so as to enclose around a periphery of the antenna and contain radiation produced by the antenna along a path that is coaxial with a centerline of the waveguide.

20 Claims, 6 Drawing Sheets

(51) Int. Cl.

| | |
|---|---|
| ***H01Q 13/18*** | (2006.01) |
| ***H01Q 1/48*** | (2006.01) |
| ***H01Q 9/04*** | (2006.01) |
| ***H01P 3/06*** | (2006.01) |
| ***H01P 5/103*** | (2006.01) |
| ***H01P 5/107*** | (2006.01) |
| ***H01P 3/127*** | (2006.01) |
| ***H01P 5/08*** | (2006.01) |
| ***H01Q 1/38*** | (2006.01) |

(52) U.S. Cl.
CPC ..... *H01P 5/103* (2013.01); *H01P 5/107* (2013.01); *H01Q 1/38* (2013.01); *H01Q 1/48* (2013.01); *H01Q 9/0407* (2013.01); *H01Q 13/06* (2013.01); *H01Q 13/18* (2013.01)

(58) Field of Classification Search
CPC ..... H01Q 1/38; H01Q 1/48; H01Q 13/02; H01Q 13/0225; H01Q 13/06; H01Q 13/12; H01Q 13/18; H01Q 13/10; H01Q 13/106; H01Q 13/0241; H01Q 13/025; H01Q 13/0275; H01Q 19/10; H01Q 19/104; H01Q 19/18; H01Q 19/185; H01Q 19/20; H01Q 13/103; H01P 1/173; H01P 3/06; H01P 3/127; H01P 5/082; H01P 5/103; H01P 5/107
See application file for complete search history.

(56) References Cited

U.S. PATENT DOCUMENTS

D227,476 S 6/1973 Kennedy
4,188,633 A 2/1980 Frazita
4,402,566 A 9/1983 Powell et al.
D273,111 S 3/1984 Hirata et al.
4,543,579 A 9/1985 Teshirogi
4,562,416 A * 12/1985 Sedivec ..... H01P 5/107 333/246
4,626,863 A 12/1986 Knop et al.
4,835,538 A 5/1989 McKenna et al.
4,866,451 A 9/1989 Chen
4,893,288 A 1/1990 Maier et al.
4,903,033 A 2/1990 Tsao et al.
4,986,764 A 1/1991 Eaby et al.
5,015,195 A 5/1991 Piriz
5,087,920 A 2/1992 Tsurumaru et al.
5,226,837 A 7/1993 Cinibulk et al.
5,231,406 A 7/1993 Sreenivas
D346,598 S 5/1994 McCay et al.
D355,416 S 2/1995 McCay et al.
5,389,941 A 2/1995 Yu
5,491,833 A 2/1996 Hamabe
5,513,380 A 4/1996 Ivanov et al.
5,539,361 A * 7/1996 Davidovitz ..... H01P 5/085 333/26
5,561,434 A 10/1996 Yamazaki
D375,501 S 11/1996 Lee et al.
5,580,264 A 12/1996 Aoyama et al.
5,684,495 A 11/1997 Dyott et al.
D389,575 S 1/1998 Grasfield et al.
5,724,666 A 3/1998 Dent
5,742,911 A 4/1998 Dumbrill et al.
5,746,611 A 5/1998 Brown et al.
5,764,696 A 6/1998 Barnes et al.
5,797,083 A 8/1998 Anderson
5,831,582 A 11/1998 Muhlhauser et al.
5,966,102 A 10/1999 Runyon
5,995,063 A 11/1999 Somoza et al.
6,014,372 A 1/2000 Kent et al.
6,067,053 A 5/2000 Runyon et al.
6,137,449 A 10/2000 Kildal
6,140,962 A 10/2000 Groenenboom
6,176,739 B1 1/2001 Denlinger et al.
6,216,266 B1 4/2001 Eastman et al.
6,271,802 B1 8/2001 Clark et al.
6,304,762 B1 10/2001 Myers et al.
D455,735 S 4/2002 Winslow
6,421,538 B1 7/2002 Byrne
6,716,063 B1 4/2004 Bryant et al.
6,754,511 B1 6/2004 Halford et al.
6,847,653 B1 1/2005 Smiroldo
D501,848 S 2/2005 Uehara et al.
6,853,336 B2 * 2/2005 Asano ..... H01Q 1/2266 343/702
6,864,837 B2 3/2005 Runyon et al.
6,877,277 B2 4/2005 Kussel et al.
6,962,445 B2 11/2005 Zimmel et al.
7,075,492 B1 7/2006 Chen et al.
D533,899 S 12/2006 Ohashi et al.
7,173,570 B1 2/2007 Wensink et al.
7,187,328 B2 * 3/2007 Tanaka ..... H01Q 9/0407 343/700 MS
7,193,562 B2 3/2007 Shtrom et al.
7,212,162 B2 * 5/2007 Jung ..... H01Q 13/02 343/700 MS
7,212,163 B2 5/2007 Huang et al.
7,245,265 B2 7/2007 Kienzle et al.
7,253,783 B2 8/2007 Chiang et al.
7,264,494 B2 9/2007 Kennedy et al.
7,281,856 B2 10/2007 Grzegorzewska et al.
7,292,198 B2 11/2007 Shtrom et al.
7,306,485 B2 12/2007 Masuzaki
7,316,583 B1 1/2008 Mistarz
7,324,057 B2 1/2008 Argaman et al.
D566,698 S 4/2008 Choi et al.
7,362,236 B2 4/2008 Hoiness
7,369,095 B2 5/2008 Hirtzlin et al.
7,380,984 B2 6/2008 Wuester
7,431,602 B2 10/2008 Corona
7,498,896 B2 * 3/2009 Shi ..... H01P 5/107 333/26
7,498,996 B2 3/2009 Shtrom et al.
7,507,105 B1 3/2009 Peters et al.
7,522,095 B1 4/2009 Wasiewicz et al.
7,542,717 B2 6/2009 Green, Sr. et al.
7,581,976 B2 9/2009 Liepold et al.
7,586,891 B1 9/2009 Masciulli
7,616,959 B2 11/2009 Spenik et al.
7,646,343 B2 1/2010 Shtrom et al.
7,675,473 B2 3/2010 Kienzle et al.
7,675,474 B2 3/2010 Shtrom et al.
7,726,997 B2 6/2010 Kennedy et al.
7,778,226 B2 8/2010 Rayzman et al.
7,857,523 B2 12/2010 Masuzaki
7,929,914 B2 4/2011 Tegreene
RE42,522 E 7/2011 Zimmel et al.
8,009,646 B2 8/2011 Lastinger et al.
8,069,465 B1 11/2011 Bartholomay et al.
8,111,678 B2 2/2012 Lastinger et al.
8,254,844 B2 8/2012 Kuffner et al.
8,270,383 B2 9/2012 Lastinger et al.
8,275,265 B2 9/2012 Kobyakov et al.
8,325,695 B2 12/2012 Lastinger et al.
D674,787 S 1/2013 Tsuda et al.
8,345,651 B2 1/2013 Lastinger et al.
8,385,305 B1 2/2013 Negus et al.
8,425,260 B2 4/2013 Seefried et al.
8,482,478 B2 7/2013 Hartenstein
8,515,434 B1 8/2013 Narendran et al.
8,515,495 B2 8/2013 Shang et al.
D694,740 S 12/2013 Apostolakis
8,777,660 B2 7/2014 Chiarelli et al.
8,792,759 B2 7/2014 Benton et al.
8,827,729 B2 9/2014 Gunreben et al.
8,836,601 B2 9/2014 Sanford et al.
8,848,389 B2 * 9/2014 Kawamura ..... H01P 1/047 361/792
8,870,069 B2 10/2014 Bellows
8,935,122 B2 1/2015 Stisser
9,001,689 B1 4/2015 Hinman et al.
9,019,874 B2 4/2015 Choudhury et al.
9,077,071 B2 7/2015 Shtrom et al.

(56) References Cited

U.S. PATENT DOCUMENTS 9,107,134 B1 8/2015 Belser et al.
9,130,305 B2 9/2015 Ramos et al.
9,161,387 B2 10/2015 Fink et al.
9,179,336 B2 11/2015 Fink et al.
9,191,081 B2 11/2015 Hinman et al.
D752,566 S 3/2016 Hinman et al.
9,295,103 B2 3/2016 Fink et al.
9,362,629 B2 6/2016 Hinman et al.
9,391,375 B1 7/2016 Bales et al.
9,407,012 B2 8/2016 Shtrom et al.
9,431,702 B2 8/2016 Hartenstein
9,504,049 B2 11/2016 Hinman et al.
9,531,114 B2 12/2016 Ramos et al.
9,537,204 B2 1/2017 Cheng et al.
9,577,340 B2 * 2/2017 Fakharzadeh ..... H01Q 13/02
9,693,388 B2 6/2017 Fink et al.
9,780,892 B2 10/2017 Hinman et al.
9,843,940 B2 12/2017 Hinman et al.
9,871,302 B2 1/2018 Hinman et al.
9,888,485 B2 2/2018 Hinman et al.
9,930,592 B2 3/2018 Hinman
9,949,147 B2 4/2018 Hinman et al.
9,986,565 B2 5/2018 Fink et al.
9,998,246 B2 6/2018 Hinman et al.
10,028,154 B2 7/2018 Elson
10,090,943 B2 10/2018 Hinman et al.
10,096,933 B2 10/2018 Ramos et al.
10,117,114 B2 10/2018 Hinman et al.
10,186,786 B2 1/2019 Hinman et al.
10,200,925 B2 2/2019 Hinman
10,257,722 B2 4/2019 Hinman et al.
10,425,944 B2 9/2019 Fink et al.
10,447,417 B2 10/2019 Hinman et al.
10,511,074 B2 12/2019 Eberhardt et al.
10,595,253 B2 3/2020 Hinman
10,616,903 B2 4/2020 Hinman et al.
2001/0033600 A1 10/2001 Yang et al.
2002/0102948 A1 8/2002 Stanwood et al.
2002/0159434 A1 10/2002 Gosior et al.
2003/0013452 A1 1/2003 Hunt et al.
2003/0027577 A1 2/2003 Brown et al.
2003/0169763 A1 9/2003 Choi et al.
2003/0222831 A1 12/2003 Dunlap
2003/0224741 A1 12/2003 Sugar et al.
2004/0002357 A1 1/2004 Benveniste
2004/0029549 A1 2/2004 Fikart
2004/0110469 A1 6/2004 Judd et al.
2004/0120277 A1 6/2004 Holur et al.
2004/0155819 A1 8/2004 Martin et al.
2004/0196812 A1 10/2004 Barber
2004/0196813 A1 10/2004 Ofek et al.
2004/0240376 A1 12/2004 Wang et al.
2004/0242274 A1 12/2004 Corbett et al.
2005/0012665 A1 1/2005 Runyon et al.
2005/0032479 A1 2/2005 Miller et al.
2005/0058111 A1 3/2005 Hung et al.
2005/0124294 A1 6/2005 Wentink
2005/0143014 A1 6/2005 Li et al.
2005/0195758 A1 9/2005 Chitrapu
2005/0227625 A1 10/2005 Diener
2005/0254442 A1 11/2005 Proctor, Jr. et al.
2005/0271056 A1 12/2005 Kaneko
2005/0275527 A1 12/2005 Kates
2006/0025072 A1 2/2006 Pan
2006/0072518 A1 4/2006 Pan et al.
2006/0098592 A1 5/2006 Proctor, Jr. et al.
2006/0099940 A1 5/2006 Pfleging et al.
2006/0132359 A1 6/2006 Chang et al.
2006/0132602 A1 6/2006 Muto et al.
2006/0172578 A1 8/2006 Parsons
2006/0187952 A1 8/2006 Kappes et al.
2006/0211430 A1 9/2006 Persico
2006/0276073 A1 12/2006 McMurray et al.
2007/0001910 A1 1/2007 Yamanaka et al.
2007/0019664 A1 1/2007 Benveniste
2007/0035463 A1 2/2007 Hirabayashi
2007/0060158 A1 3/2007 Medepalli et al.
2007/0132643 A1 6/2007 Durham et al.
2007/0173199 A1 7/2007 Sinha
2007/0173260 A1 7/2007 Love et al.
2007/0202809 A1 8/2007 Lastinger et al.
2007/0210974 A1 9/2007 Chiang
2007/0223701 A1 9/2007 Emeott et al.
2007/0238482 A1 10/2007 Rayzman et al.
2007/0255797 A1 11/2007 Dunn et al.
2007/0268848 A1 11/2007 Khandekar et al.
2008/0109051 A1 5/2008 Splinter et al.
2008/0112380 A1 5/2008 Fischer
2008/0192707 A1 8/2008 Xhafa et al.
2008/0218418 A1 9/2008 Gillette
2008/0231541 A1 9/2008 Teshirogi et al.
2008/0242342 A1 10/2008 Rofougaran
2009/0046673 A1 2/2009 Kaidar
2009/0051597 A1 2/2009 Wen et al.
2009/0052362 A1 2/2009 Meier et al.
2009/0059794 A1 3/2009 Frei
2009/0075606 A1 3/2009 Shtrom et al.
2009/0096699 A1 4/2009 Chiu et al.
2009/0232026 A1 9/2009 Lu
2009/0233475 A1 9/2009 Mildon et al.
2009/0291690 A1 11/2009 Guvenc et al.
2009/0315792 A1 12/2009 Miyashita et al.
2010/0029282 A1 2/2010 Stamoulis et al.
2010/0039340 A1 2/2010 Brown
2010/0046650 A1 2/2010 Jongren et al.
2010/0067505 A1 3/2010 Fein et al.
2010/0085950 A1 4/2010 Sekiya et al.
2010/0091818 A1 4/2010 Sen et al.
2010/0103065 A1 4/2010 Shtrom et al.
2010/0103066 A1 4/2010 Shtrom et al.
2010/0136978 A1 6/2010 Cho et al.
2010/0151877 A1 6/2010 Lee et al.
2010/0167719 A1 7/2010 Sun et al.
2010/0171665 A1 7/2010 Nogami
2010/0171675 A1 7/2010 Borja et al.
2010/0189005 A1 7/2010 Bertani et al.
2010/0202613 A1 8/2010 Ray et al.
2010/0210147 A1 8/2010 Hauser
2010/0216412 A1 8/2010 Rofougaran
2010/0225529 A1 9/2010 Landreth et al.
2010/0238083 A1 9/2010 Malasani
2010/0304680 A1 12/2010 Kuffner et al.
2010/0311321 A1 12/2010 Morin
2010/0315307 A1 12/2010 Syed et al.
2010/0322219 A1 12/2010 Fischer et al.
2011/0006956 A1 1/2011 McCown
2011/0028097 A1 2/2011 Memik et al.
2011/0032159 A1 2/2011 Wu et al.
2011/0044186 A1 2/2011 Jung et al.
2011/0090129 A1 4/2011 Weily et al.
2011/0103309 A1 5/2011 Wang et al.
2011/0111715 A1 5/2011 Buer et al.
2011/0112717 A1 5/2011 Resner
2011/0133996 A1 6/2011 Alapuranen
2011/0170424 A1 7/2011 Safavi
2011/0172916 A1 7/2011 Pakzad et al.
2011/0182260 A1 7/2011 Sivakumar et al.
2011/0182277 A1 7/2011 Shapira
2011/0194644 A1 8/2011 Liu et al.
2011/0206012 A1 8/2011 Youn et al.
2011/0241969 A1 10/2011 Zhang et al.
2011/0243291 A1 10/2011 McAllister et al.
2011/0256874 A1 10/2011 Hayama et al.
2011/0291914 A1 12/2011 Lewry et al.
2012/0008542 A1 1/2012 Koleszar et al.
2012/0040700 A1 2/2012 Gomes et al.
2012/0057533 A1 3/2012 Junell et al.
2012/0093091 A1 4/2012 Kang et al.
2012/0115487 A1 5/2012 Josso
2012/0134280 A1 5/2012 Rotvold et al.
2012/0140651 A1 6/2012 Nicoara et al.
2012/0200449 A1 8/2012 Bielas
2012/0238201 A1 9/2012 Du et al.
2012/0263145 A1 10/2012 Marinier et al.

(56) References Cited

U.S. PATENT DOCUMENTS

| | | | |
|---|---|---|---|
| 2012/0282868 | A1 | 11/2012 | Hahn |
| 2012/0299789 | A1 | 11/2012 | Orban et al. |
| 2012/0314634 | A1 | 12/2012 | Sekhar |
| 2013/0003645 | A1 | 1/2013 | Shapira et al. |
| 2013/0005350 | A1 | 1/2013 | Campos et al. |
| 2013/0023216 | A1 | 1/2013 | Moscibroda et al. |
| 2013/0044028 | A1 | 2/2013 | Lea et al. |
| 2013/0064161 | A1 | 3/2013 | Hedayat et al. |
| 2013/0082899 | A1 | 4/2013 | Gomi |
| 2013/0095747 | A1 | 4/2013 | Moshfeghi |
| 2013/0128858 | A1 | 5/2013 | Zou et al. |
| 2013/0176902 | A1 | 7/2013 | Wentink et al. |
| 2013/0182652 | A1 | 7/2013 | Tong et al. |
| 2013/0195081 | A1 | 8/2013 | Merlin et al. |
| 2013/0210457 | A1 | 8/2013 | Kummetz |
| 2013/0223398 | A1 | 8/2013 | Li et al. |
| 2013/0234898 | A1 | 9/2013 | Leung et al. |
| 2013/0271319 | A1 | 10/2013 | Trerise |
| 2013/0286950 | A1 | 10/2013 | Pu |
| 2013/0286959 | A1 | 10/2013 | Lou et al. |
| 2013/0288735 | A1 | 10/2013 | Guo |
| 2013/0301438 | A1 | 11/2013 | Li et al. |
| 2013/0322276 | A1 | 12/2013 | Pelletier et al. |
| 2013/0322413 | A1 | 12/2013 | Pelletier et al. |
| 2014/0024328 | A1 | 1/2014 | Balbien et al. |
| 2014/0051357 | A1 | 2/2014 | Steer et al. |
| 2014/0098748 | A1 | 4/2014 | Chan et al. |
| 2014/0113676 | A1 | 4/2014 | Hamalainen et al. |
| 2014/0145890 | A1 | 5/2014 | Ramberg et al. |
| 2014/0154895 | A1 | 6/2014 | Poulsen et al. |
| 2014/0185494 | A1 | 7/2014 | Yang et al. |
| 2014/0191918 | A1 | 7/2014 | Cheng et al. |
| 2014/0198867 | A1 | 7/2014 | Sturkovich et al. |
| 2014/0206322 | A1 | 7/2014 | Dimou et al. |
| 2014/0225788 | A1 | 8/2014 | Schulz et al. |
| 2014/0233613 | A1 | 8/2014 | Fink et al. |
| 2014/0235244 | A1 | 8/2014 | Hinman |
| 2014/0253378 | A1 | 9/2014 | Hinman |
| 2014/0253402 | A1 | 9/2014 | Hinman et al. |
| 2014/0254700 | A1 | 9/2014 | Hinman et al. |
| 2014/0256166 | A1 | 9/2014 | Ramos et al. |
| 2014/0320306 | A1 | 10/2014 | Winter |
| 2014/0320377 | A1 | 10/2014 | Cheng et al. |
| 2014/0328238 | A1 | 11/2014 | Seok et al. |
| 2014/0355578 | A1 | 12/2014 | Fink et al. |
| 2014/0355584 | A1 | 12/2014 | Fink et al. |
| 2015/0002335 | A1 | 1/2015 | Hinman et al. |
| 2015/0002354 | A1* | 1/2015 | Knowles ..... H01Q 13/0275 343/786 |
| 2015/0015435 | A1 | 1/2015 | Shen et al. |
| 2015/0116177 | A1 | 4/2015 | Powell et al. |
| 2015/0156642 | A1 | 6/2015 | Sobczak et al. |
| 2015/0215952 | A1 | 7/2015 | Hinman et al. |
| 2015/0256275 | A1 | 9/2015 | Hinman et al. |
| 2015/0263816 | A1 | 9/2015 | Hinman et al. |
| 2015/0319584 | A1 | 11/2015 | Fink et al. |
| 2015/0321017 | A1 | 11/2015 | Perryman et al. |
| 2015/0325945 | A1 | 11/2015 | Ramos et al. |
| 2015/0327272 | A1 | 11/2015 | Fink et al. |
| 2015/0365866 | A1 | 12/2015 | Hinman et al. |
| 2016/0119018 | A1 | 4/2016 | Lindgren et al. |
| 2016/0149634 | A1 | 5/2016 | Kalkunte et al. |
| 2016/0149635 | A1 | 5/2016 | Hinman et al. |
| 2016/0211583 | A1 | 7/2016 | Lee et al. |
| 2016/0240929 | A1 | 8/2016 | Hinman et al. |
| 2016/0338076 | A1 | 11/2016 | Hinman et al. |
| 2016/0365666 | A1 | 12/2016 | Ramos et al. |
| 2016/0366601 | A1 | 12/2016 | Hinman et al. |
| 2017/0048647 | A1 | 2/2017 | Jung et al. |
| 2017/0238151 | A1 | 8/2017 | Fink et al. |
| 2017/0294975 | A1 | 10/2017 | Hinman et al. |
| 2018/0034166 | A1 | 2/2018 | Hinman |
| 2018/0035317 | A1 | 2/2018 | Hinman et al. |
| 2018/0083365 | A1 | 3/2018 | Hinman et al. |
| 2018/0084563 | A1 | 3/2018 | Hinman et al. |
| 2018/0160353 | A1 | 6/2018 | Hinman |
| 2018/0192305 | A1 | 7/2018 | Hinman et al. |
| 2018/0199345 | A1 | 7/2018 | Fink et al. |
| 2018/0241491 | A1 | 8/2018 | Hinman et al. |
| 2019/0006789 | A1 | 1/2019 | Ramos et al. |
| 2019/0182686 | A1 | 6/2019 | Hinman et al. |
| 2019/0214699 | A1 | 7/2019 | Eberhardt et al. |
| 2019/0215745 | A1 | 7/2019 | Hinman |
| 2019/0273326 | A1 | 9/2019 | Sanford et al. |
| 2020/0015231 | A1 | 1/2020 | Fink et al. |
| 2020/0036465 | A1 | 1/2020 | Hinman et al. |
| 2020/0067164 | A1 | 2/2020 | Eberhardt et al. |
| 2020/0083614 | A1 | 3/2020 | Sanford et al. |

FOREIGN PATENT DOCUMENTS

| | | | |
|---|---|---|---|
| CN | 105191204 | A | 12/2015 |
| CN | 105191204 | B | 5/2019 |
| EM | 002640177 | A1 | 2/2015 |
| EP | 1384285 | B1 | 6/2007 |
| EP | 3491697 | A1 | 6/2019 |
| WO | WO2014137370 | A1 | 9/2014 |
| WO | WO2014138292 | A1 | 9/2014 |
| WO | WO2014193394 | A1 | 12/2014 |
| WO | WO2015112627 | A2 | 7/2015 |
| WO | WO2017123558 | A1 | 7/2017 |
| WO | WO2018022526 | A1 | 2/2018 |
| WO | WO2019136257 | A1 | 7/2019 |
| WO | WO2019168800 | A1 | 9/2019 |

OTHER PUBLICATIONS

Liu, Lingjia et al., "Downlink MIMO in LTE-Advanced: SU-MIMO vs. MU-MIMO," IEEE Communications Magazine, Feb. 2012, pp. 140-147.

International Search Report and "Written Opinion of the International Searching Authority," Patent Cooperation Treaty Application No. PCT/US2017/012884, dated Apr. 6, 2017, 9 pages.

International Search Report and Written Opinion of the International Search Authority dated Nov. 26, 2013 in Patent Cooperation Treaty Application No. PCT/US2013/047406, filed Jun. 24, 2013, 9 pages.

International Search Report and Written Opinion of the International Search Authority dated Aug. 9, 2013 in Patent Cooperation Treaty Application No. PCT/US2013/043436, filed May 30, 2013, 13 pages.

International Search Report and Written Opinion of the International Search Authority dated Jul. 1, 2014 in Patent Cooperation Treaty Application No. PCT/US2014/020880, filed Mar. 5, 2014, 14 pages.

International Search Report and Written Opinion of the International Search Authority dated Jun. 29, 2015 in Patent Cooperation Treaty Application No. PCT/US2015/012285, filed Jan. 21, 2015, 15 pages.

Hinman et al., U.S. Appl. No. 61/774,632, filed Mar. 7, 2013, 23 pages.

First Official Notification dated Jun. 15, 2015 in Chinese Design Patent Application 201530058063.8, filed Mar. 11, 2015, 1 page.

Notice of Allowance dated Sep. 8, 2015 in Chinese Design Patent Application 2015300580618, filed Mar. 11, 2015, 3 pages.

"Office Action," Chinese Patent Application No. 201580000078.6, dated Nov. 3, 2017, 5 pages [10 pages including translation].

"Office Action," Chinese Patent Application No. 201580000078.6, dated Jul. 30, 2018, 5 pages [11 pages including translation].

"Office Action," Chinese Patent Application No. 201580000078.6, dated Oct. 31, 2018, 3 pages [6 pages including translation].

"Notice of Allowance," Chinese Patent Application No. 201580000078.6, dated Feb. 11, 2019, 2 pages.

"International Search Report" and "Written Opinion of the International Search Authority," dated Mar. 22, 2019 in Patent Cooperation Treaty Application No. PCT/US2019/012358, filed Jan. 4, 2019, 9 pages.

FCC Regulations, 47 CFR § 15.407, 63 FR 40836, Jul. 31, 1998, as amended at 69 FR 2687, Jan. 20, 2004; 69 FR 54036, Sep. 7, 2004; pp. 843-846.

(56) References Cited

OTHER PUBLICATIONS

"International Search Report" and "Written Opinion of the International Search Authority," dated May 23, 2019 in Patent Cooperation Treaty Application No. PCT/US2019/019462, filed Feb. 25, 2019, 8 pages.
Teshirogi, Tasuku et al., "Wideband Circularly Polarized Array Antenna with Sequential Rotations and Phase Shift of Elements," Proceedings of the International Symposium on Antennas and Propagation, 1985, pp. 117-120.
"Sector Antennas," Radiowaves.com, [online], [retrieved Oct. 10, 2019], Retrieved from the Internet: <URL:https://www.radiowaves.com/en/products/sector-antennas>, 4 pages.
KP Performance Antennas Search Results for Antennas, Sector, Single, [online], KPPerformance.com [retrieved Oct. 10, 2019], Retrieved from the Internet: <URL:https://www.kpperformance.com/search?Category=Antennas&Rfpsan99design=Sector&Rfpsan99option=Single&view_type=grid>, 6 pages.
"Partial Supplemental European Search Report," European Patent Application No. 17835073.2, dated Feb. 13, 2020, 17 pages.
"Wireless Access Point," Wikipedia.org, Jan. 6, 2020 [retrieved on Feb. 3, 2020], Retrieved from the Internet: <https://en.wikipedia.org/wiki/Wireless_access_point>, 5 pages.
"Extended European Search Report", European Patent Application No. 17835073.2, dated Jun. 30, 2020, 15 pages.
Haupt, R.T., "Antenna Arrays: A Computational Approach", Chapter 5: Non-Planar Arrays; Wiley-IEEE Press (2010), pp. 287-338.

* cited by examiner

PRINTED CIRCUIT BOARD MOUNTED ANTENNA AND WAVEGUIDE INTERFACE

CROSS REFERENCE TO RELATED APPLICATION

This application claims the benefit and priority of U.S. Provisional Application Ser. No. 62/277,448, filed on Jan. 11, 2016, which is hereby incorporated by reference herein including all references and appendices cited therein.

FIELD OF THE PRESENT DISCLOSURE

The present disclosure relates generally to transition hardware between waveguide transmission lines and printed circuit and/or coaxial transmission lines. This present disclosure describes embodiments with an antenna feed but it is not specifically limited to that particular application.

SUMMARY

According to some embodiments, the present disclosure is directed to a device that comprises: (a) a dielectric substrate; (b) an electrical feed; (b) an antenna mounted onto the dielectric substrate and connected to the electrical feed; and (c) an elongated waveguide mounted onto the dielectric substrate so as to enclose around a periphery of the antenna and contain radiation produced by the antenna along a path that is coaxial with a centerline of the waveguide.

According to some embodiments, the present disclosure is directed to a device that comprises: (a) a dielectric substrate comprising an electrical feed that comprises at least one of a printed circuit transmission line and a coaxial cable; (b) a metallic layer applied to the dielectric substrate and connected to the electrical feed, wherein the metallic layer comprises a slot radiator; and (c) an elongated waveguide mounted onto the dielectric substrate so as to enclose around a periphery of the slot radiator and contain and direct radiation produced within the slot radiator along a path that is coaxial with a centerline of the waveguide.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DESCRIPTION OF EXEMPLARY EMBODIMENTS

Generally, the present disclosure is directed to waveguides that are mounted directly to a printed circuit board. These waveguides can have any variety of geometrical shapes and cross sections. The shape and/or cross section of a waveguide can be continuous along its length or can vary according to various design requirements such as impedance matching and/or for frequency tuning of the radiation emitted by the patch antenna or slot antenna incorporated into the printed circuit board. These and other advantages of the present disclosure are described in greater detail infra. Current practice is to excite a waveguide with a probe or monopole antenna. The probe can be a wire attached to a coaxial transmission or a feature imbedded in a PCB. This technique produces waves traveling in both directions down a waveguide. The backward going wave is usually reflected by a shorting plate in the waveguide, typically placed a quarter of a wavelength away from the feed probe. This disclosure contemplates launching a wave traveling in only one direction, thus, simplifying the construction of the interface and making it more robust.

Figure 1:
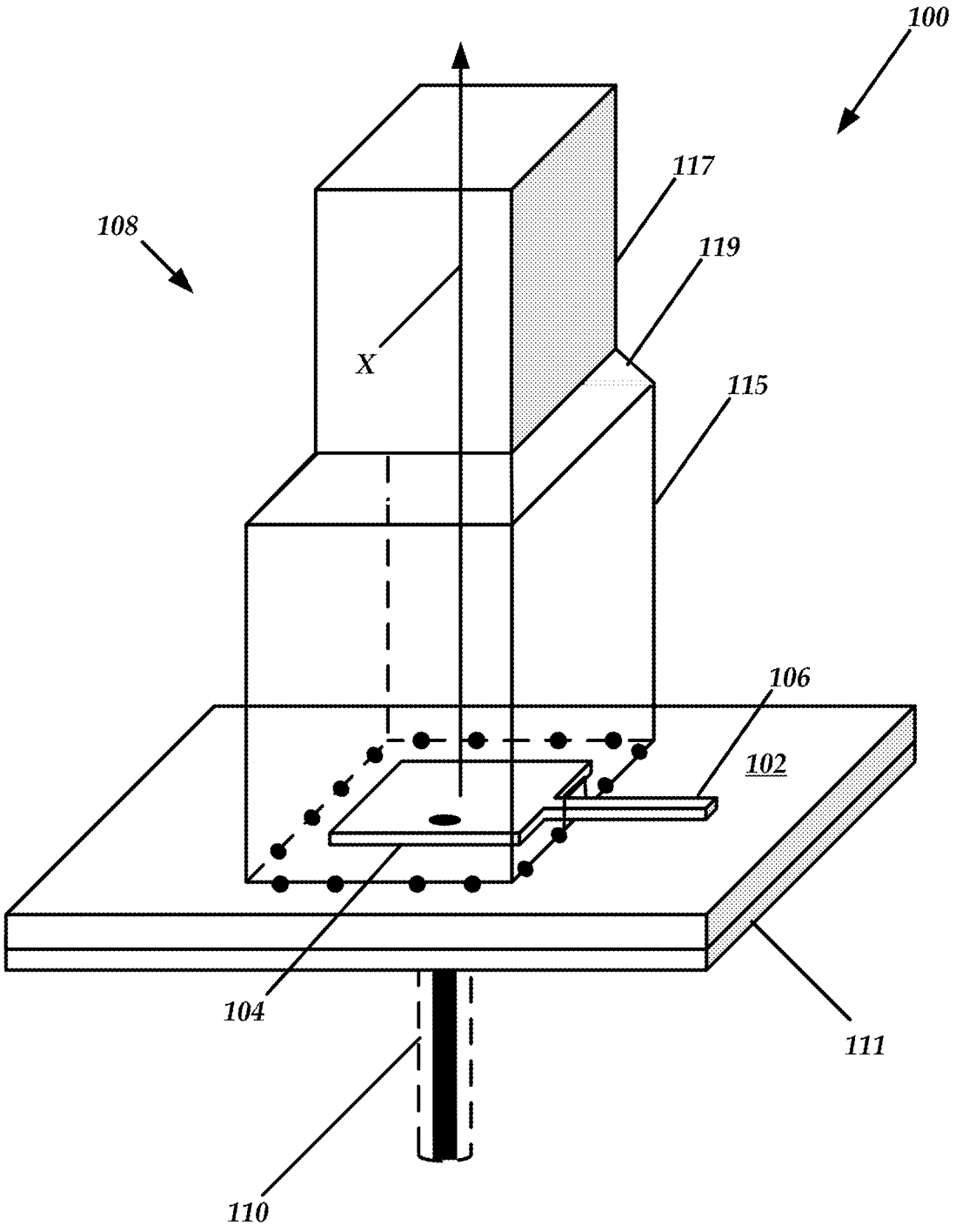
FIG. 1 is a perspective view of an example device constructed in accordance with the present disclosure, having a waveguide of transitional cross section along its length.
Figure 3:
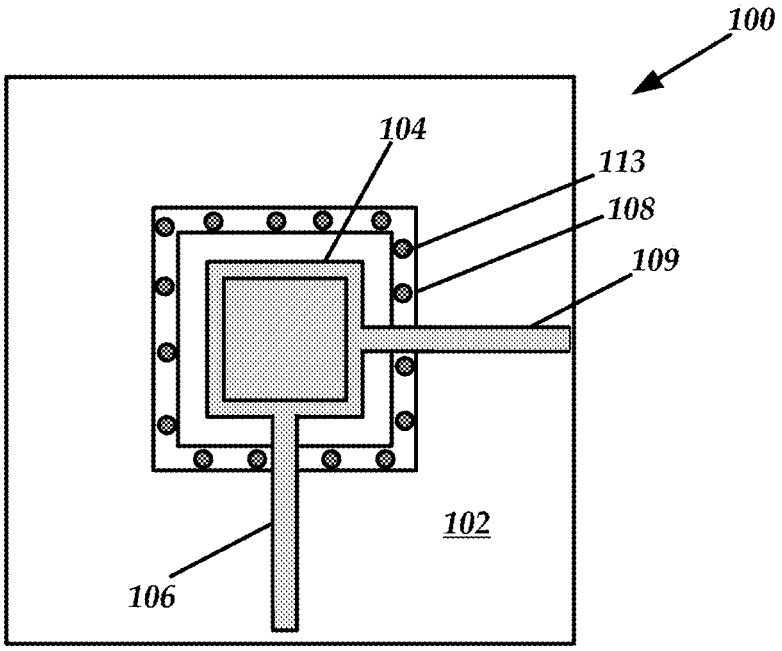
FIG. 3 is a top down view of an example device constructed in accordance with the present disclosure.

FIG. 1 is an example device 100 that is constructed in accordance with the present disclosure. The device 100 comprises a dielectric substrate 102, an antenna 104, a feed strip 106, a waveguide 108, and a ground plane 111. The device 100 can include additional or fewer components than those illustrated. A single feed strip 106 is illustrated but device 100 is not so limited. Additional feed strips can be utilized in some embodiments. The feed strip 106 can comprise a printed circuit transmission line, in some embodiments (as illustrated in FIG. 3).

The dielectric substrate 102 can comprise any suitable PCB (printed circuit board) substrate material constructed from, for example, one or more dielectric materials. The antenna 104 is mounted onto the dielectric substrate 102. In one embodiment the antenna 104 is a patch antenna. In another embodiment, the antenna 104 is a multi-stack set of antennas. In some embodiments, the antenna 104 is electrically coupled with one or more printed circuit transmission lines (such as two or more feed strips, such as feed strip 106 as illustrated in FIG. 3).

Various embodiments of the waveguide 108 are illustrated in FIGS. 1-7. While the waveguide 108 is generally elongated, the waveguide 108 can comprise a truncated or short embodiment of a waveguide.

For context, without the waveguide 108, the antenna 104 emits signal radiation in a plurality of directions, causing loss of signal strength, reduced signal directionality, as well as cross-port interference (e.g., where an adjacent antenna is affected by the antenna 104).

Thus, in various embodiments, the waveguide 108 is mounted directly to the dielectric substrate 102, around a periphery of the antenna 104. The spacing between the waveguide 108 and the antenna 104 can be varied according to design parameters.

In one embodiment the waveguide 108 encloses the antenna 104 and captures the radiation of the antenna 104, directing it along and out of the waveguide 108. The waveguide 108 is constructed from any suitable conductive material. The use of the waveguide 108 allows one to transfer signals from one location to another location with minimal loss or disturbance of the signal.

In various embodiments, the length of the waveguide 108 is selected according to design requirements, such as required signal symmetry. The waveguide 108 can have any desired shape and/or size and length. The illustrated waveguide 108 is rectangular in shape, but any polygonal, cylindrical, or irregular shape can be implemented as desired.

Figure 2:
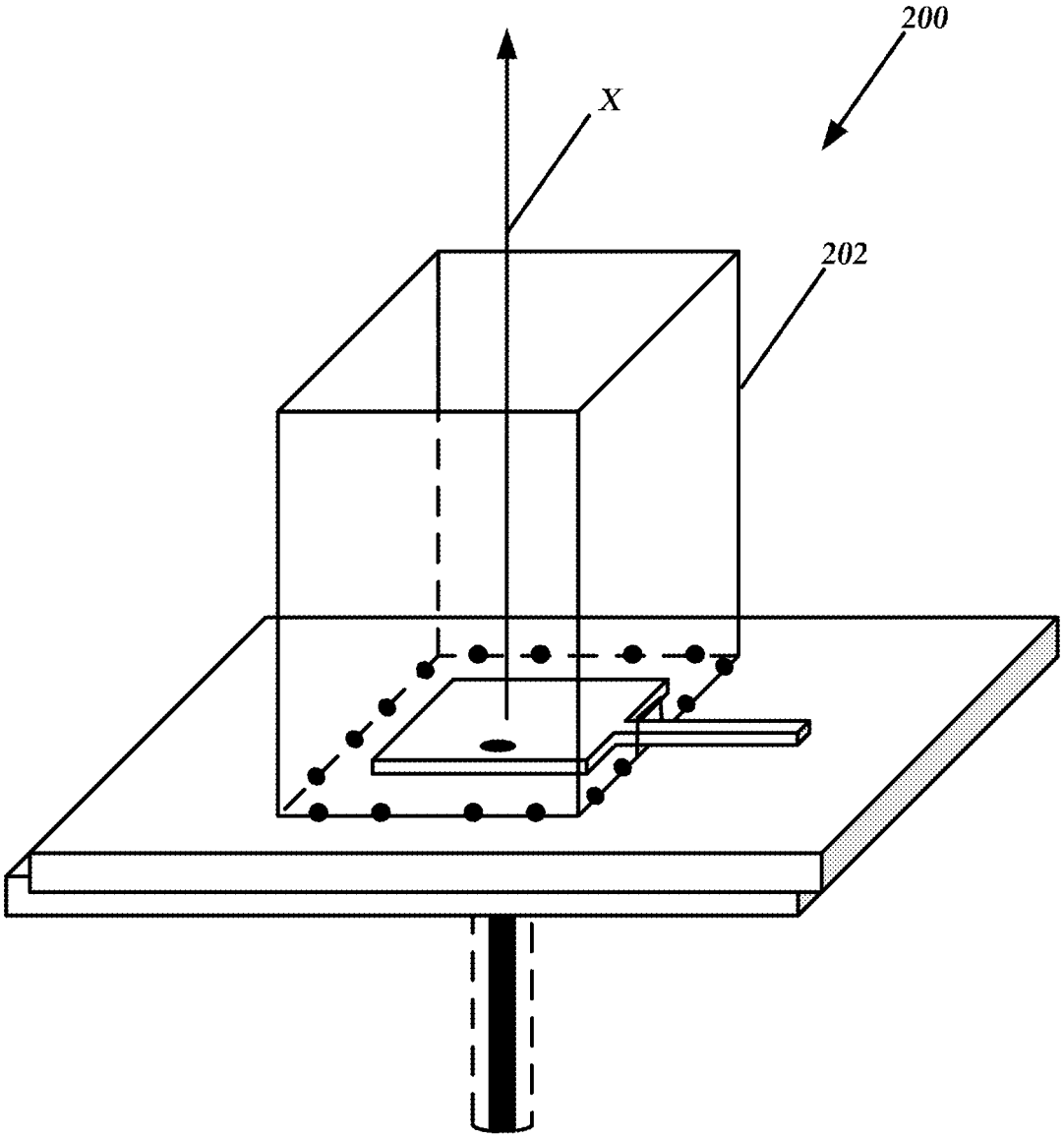
FIG. 2 is a perspective view of an example device constructed in accordance with the present disclosure, having a waveguide of uniform cross section along its length. In general, the waveguide cross section could be changed. For example the shape in the immediate vicinity could have a particular shape and that shape could be modified to interface with a waveguide with another cross section as one example for such a change.

FIG. 2 illustrates another device 200 that is constructed identically to the device 100 of FIG. 1 with the exception that the waveguide 202 has a continuous cross section along its entire length.

As illustrated in FIG. 3, the waveguide 108 is coupled to the ground plane 111 (not shown in FIG. 3) through conductive vias, such as via 113, which extend through the dielectric substrate 102, in some embodiments. Also, as mentioned above, the antenna 104 is coupled with two printed circuit transmission lines (which can comprise the feed strip) 106 and another feed strip 109. In various embodiments, the use of two feed lines (or feed lines/strips and coaxial cables) allows for dual linear (or dual circular) polarization. Additional feeds could be used to excite multiple, higher order modes in a particular waveguide. The use of this feed in conjunction with a Potter horn is one possible application for the excitation of multiple, simultaneous, higher order modes.

Indeed, feed lines/strips as well as coaxial cables as described herein can be generally referred to as an electrical feed.

Referring back to FIG. 1, in some embodiments, the waveguide 108 can comprise two sections of different size and/or cross section from one another. For example, the waveguide 108 of FIG. 1 comprises a first portion 115 having a rectangular cross section. The waveguide 108 comprises a second portion 117 that also has a rectangular cross section. The first portion 115 transitions to the second portion 117 using a transition section 119. The slope or angle of the sides of the transition section 119 can vary according to design requirements.

Figure 5:
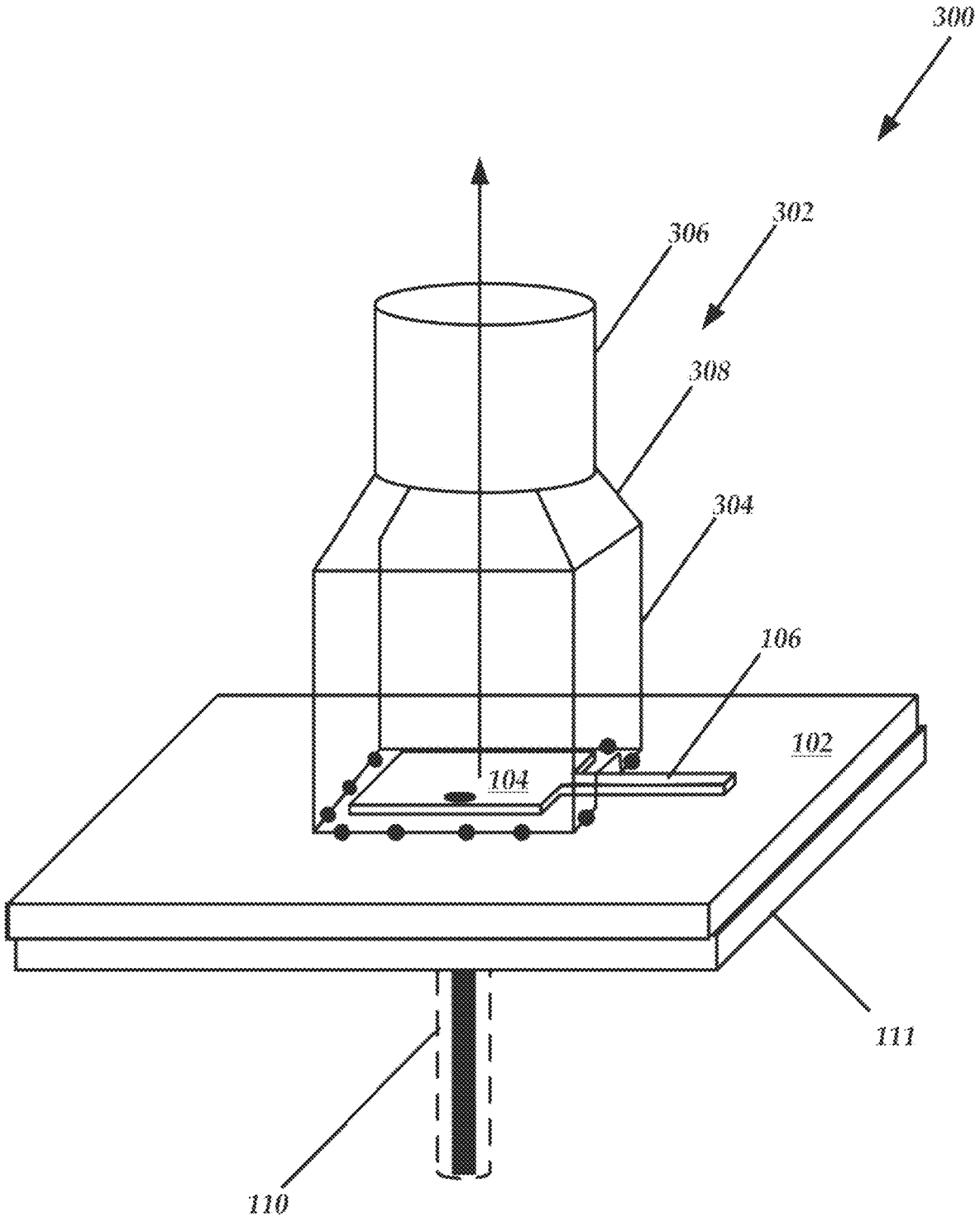
FIG. 5 is a perspective view of an example device constructed in accordance with the present disclosure, having a waveguide of transitional cross section along its length, and having both a polygonal section and a cylindrical section.

In various embodiments, the transition section 119 allows the shape of the signal radiation that is emitted to be changed. For example, the transition section 119 can be circular in shape while the waveguide 108 is square, such as illustrated in FIG. 5. This allows for optimum radiation reflection and symmetry near the antenna 104, while providing a desired emitted signal shape through the transition section 119.

The waveguide 108 contains radiation produced by the antenna 104 and directs the radiation along a path that is coaxial with a centerline X of the waveguide 108, in some embodiments.

In various embodiments, the selection of dielectric materials for the waveguide 108 can be used to effectively adjust a physical size of either the waveguide and/or antenna patch while keeping the electrical characteristics compatible.

Referring to FIG. 1, in some embodiments, the antenna 104 is coupled with a coaxial cable 110 to a signal source such as a radio. In other embodiments, the antenna 104 is coupled to a radio (not shown) with a PCB (printed circuit board) based transmission line or feed strip 106. In some embodiments, the coaxial cable 110 is used in place of the feed strip 106. In some embodiments, the coaxial cable 110 is used in combination with one or more feed strips, such as feed strip 106.

Advantageously, the device 100 provides high levels of signal isolation between adjacent feeds, in various embodiments. The device 100 can also allow for linear or circular waves to be easily directed as desired. A narrow or wide bandwidth transition can be utilized, in some embodiments.

The present disclosure is not limited to using a single planar patch antenna when other antennas are advantageous. For example, inverted F-antennas, cavity backed slots, and planar inverted F-antennas can also be utilized. Multiple patches and feeds, slightly displaced in the waveguide could be used, for example, to increase bandwidth. This idea is fundamental to how a log-periodic dipole works.

Figure 4:
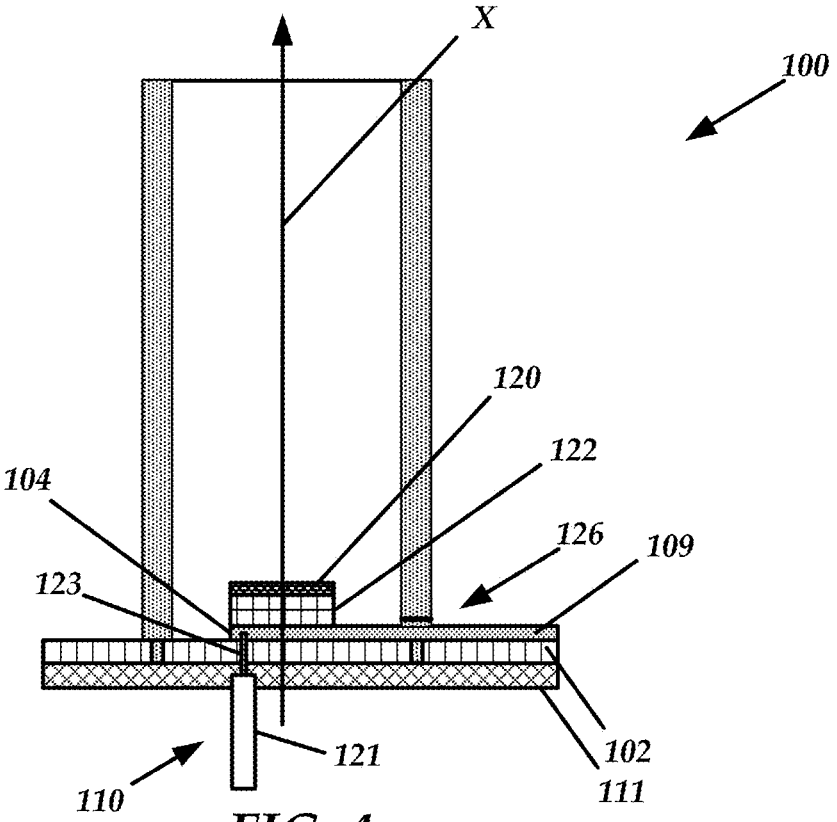
FIG. 4 is a cross sectional view of an example device constructed in accordance with the present disclosure.

FIG. 4 illustrates the use of a parasitic patch 120 that is placed in a spaced apart relationship to the antenna 104. Again, the ground plane 111 is placed below the dielectric substrate 102 and the antenna 104 is mounted to the dielectric substrate 102. In some embodiments, the antenna 104 is partially or totally embedded in the dielectric substrate 102. The parasitic patch 120 is placed above the antenna 104. In some embodiments a spacer 122 is placed between the parasitic patch 120 and the antenna 104. In one or more embodiments, the spacer 122 comprises a Mylar sheet, a foam block, a low-density plastic block, or other similar material that does not impede (or has very low impedance or absorption of) the radiation emitted from the antenna 104. In general, the parasitic patch 120 functions to improve bandwidth and other operational parameters of the device 100. In some embodiments, a perimeter of the parasitic patch 120 is smaller than a perimeter of the antenna 104.

In some embodiments, a coaxial cable 110 comprises an outer section 121 that is in electrical contact with the ground plane 111 and an inner section 123 that is in electrical contact with the antenna 104.

According to some embodiments, the waveguide 108 comprises an aperture or pass through 126 that allow the feed strip 106 to enter the waveguide 108 without contacting the waveguide 108.

FIG. 5 illustrates another device 300 of embodiments of the present technology that is constructed identically to the device 100 of FIG. 1 with the exception that the waveguide 302 has a first section 304 that has a polygonal cross section and a second section 306 that has a cylindrical cross section. A transition section 308 couples the first section 304 and the second section 306.

Figure 6:
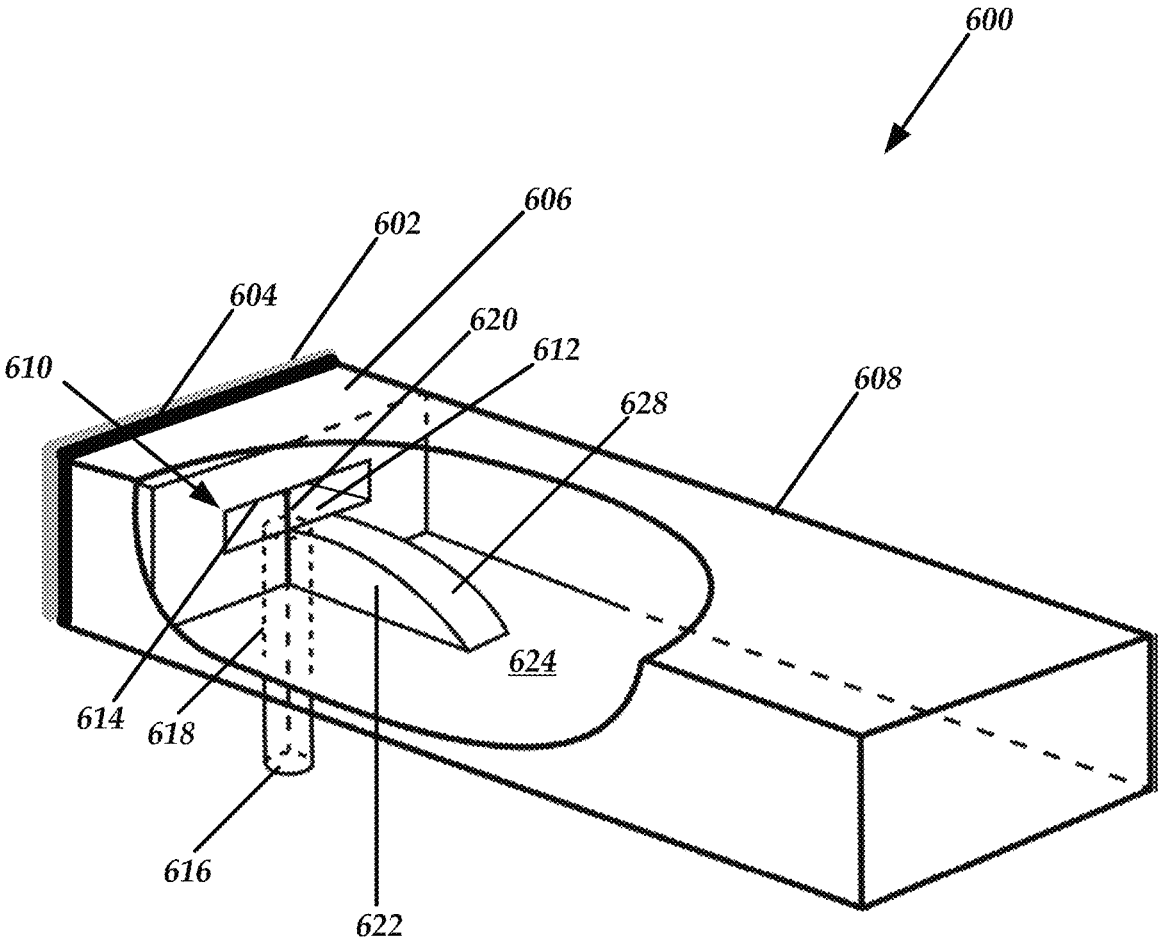
FIG. 6 is a perspective, partial cutaway view of another example device constructed in accordance with the present disclosure that comprises a slot antenna element.

FIG. 6 illustrates another device 600 of embodiments of the present disclosure. The device 600 comprises a ground plane 602, a dielectric substrate 604, a metallic layer 606, and a rectangular waveguide 608. The transition between the dielectric substrate 604 and the rectangular waveguide 608 is accomplished using a slot radiator 610 located inside the rectangular waveguide 608.

In various embodiments, the slot radiator 610 is created within the metallic layer 606 which comprises an aperture or notch that defines the slot radiator 610. The slot radiator 610 is defined by a sidewall that includes at least a first side 612 and a second side 614.

In some embodiments, the slot radiator 610 is coupled with a coaxial cable 616, although a feed strip (printed circuit transmission line) can be used as well. In one embodiment, an outer section 618 of the coaxial cable 616 terminates at the first side 612 of the slot radiator 610 and an inner section 620 of the coaxial cable 616 terminates at the second side 614 of the slot radiator 610. That is, the inner section 620 of the coaxial cable 616 extends across an opening of the slot radiator 610 in the space that exists between the first side 612 and the second side 614.

In various embodiments, a variety of methods may be used to excite the slot radiator 610, which may be cavity backed. While the coaxial cable 616 is illustrated as connecting to the slot radiator 610 perpendicularly, the feed (i.e. either the coaxial cable 616 or feed lines/strips) could also be coupled with a back of the rectangular waveguide 608.

In some embodiments, the device 600 comprises a tapered ridge 622. The tapered ridge 622 contacts an inner surface 624 of the rectangular waveguide 608 and abuts the slot radiator 610. In one or more embodiments, the tapered ridge 622 comprises an arcuate surface 628 that abuts the slot radiator 610 and terminates against the inner surface 624 of the rectangular waveguide 608.

In one or more embodiments, the tapered ridge 622 is aligned with a centerline of the slot radiator 610. The tapered ridge 622 can also be offset from the slot radiator 610 in other embodiments.

Figure 7:
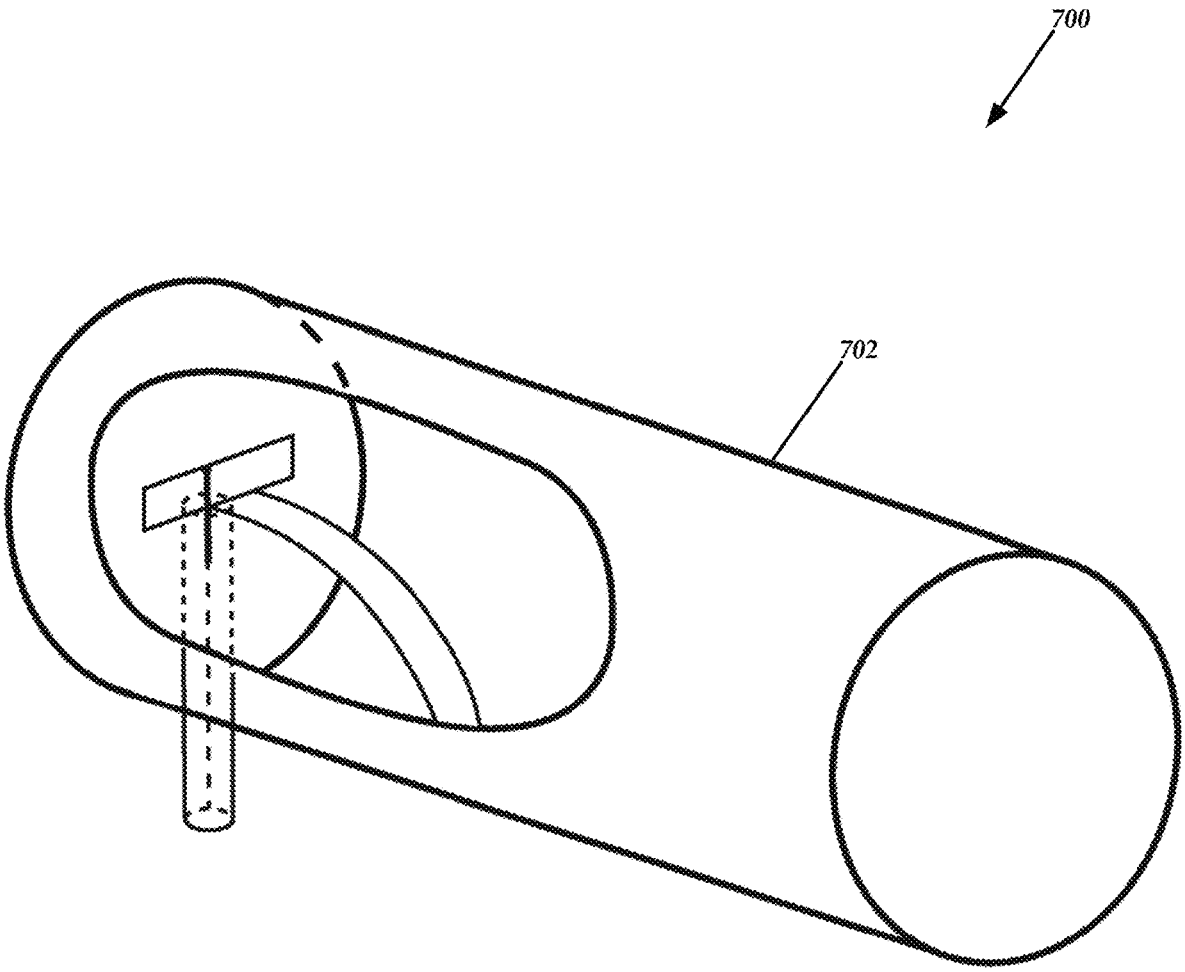
FIG. 7 is a perspective, partial cutaway view of another example device constructed in accordance with the present disclosure that comprises a slot antenna element and comprising a cylindrical waveguide.

The depicted rectangular waveguide 608 in FIG. 6 is rectangular, but other waveguide contours are practical in various embodiments of the present technology, including but not limited to square, circular, and elliptical cross sections. For example, FIG. 7 illustrates another device 700 with a cylindrical waveguide 702. Some of the details of the device 700 have been omitted such as the ground plane and dielectric substrate.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present disclosure. As such, some of the components may have been distorted from their actual scale for pictorial clarity.

While this technology is susceptible of embodiment in many different forms, there is shown in the drawings and has been described in detail several specific embodiments with the understanding that the present disclosure is to be considered as an exemplification of the principles of the technology and is not intended to limit the technology to the embodiments illustrated.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A device, comprising:

a dielectric substrate;

an electrical feed comprising one or more feed strips;

an antenna mounted onto the dielectric substrate and connected to the electrical feed;

a parasitic patch disposed above and aligned with the antenna; and an elongated waveguide mounted onto the dielectric substrate so as to enclose around a periphery of the antenna and contain radiation produced by the antenna along a path that is coaxial with a centerline of the waveguide, the waveguide further comprising an aperture that allows the one or more feed strips to enter the waveguide without contacting the waveguide.

2. The device according to claim 1, further comprising a ground plane mounted to a lower surface of the dielectric substrate.

3. The device according to claim 2, wherein the elongated waveguide is coupled with the ground plane through a series of conductive vias that extend through the dielectric substrate.

4. The device according to claim 1, wherein the electrical feed comprises a coaxial cable comprising an outer portion that is in electrical contact with the dielectric substrate and an inner portion that is in electrical contact with the antenna.

5. The device according to claim 1, wherein the antenna comprises a patch antenna.

6. The device according to claim 1, wherein the elongated waveguide has a polygonal cross sectional area.

7. The device according to claim 1, wherein the elongated waveguide has a cylindrical cross sectional area.

8. The device according to claim 1, wherein the elongated waveguide comprises a first section, a second section, and a transition section disposed between the first section and the second section, the first section having at least one of a different cross-sectional cavity area and a different cross-sectional cavity shape than the second section.

9. The device according to claim 8, wherein the second section has a cylindrical cross sectional area.

10. The device according to claim 1, further comprising a parasitic patch disposed in a spaced apart relationship above the antenna.

11. The device according to claim 10, further comprising a spacer disposed between the parasitic patch and the antenna.

12. A device, comprising:

a dielectric substrate comprising an electrical feed that comprises at least one of a printed circuit transmission line and a coaxial cable;

a metallic layer applied to the dielectric substrate, wherein the metallic layer comprises a slot radiator and is connected to the electrical feed, the coaxial cable connected to the slot radiator perpendicularly; and an elongated waveguide mounted onto the dielectric substrate so as to enclose around a periphery of the slot radiator and to contain and direct radiation produced within the slot radiator along a path that is coaxial with a centerline of the elongated waveguide, the waveguide further comprising an aperture that allows the printed circuit transmission line to enter the waveguide without contacting the waveguide.

13. The device according to claim 12, wherein the coaxial cable comprises an inner portion and an outer portion, wherein the outer portion of the coaxial cable terminates on a first side of the slot radiator and the inner portion of the coaxial cable extends across an opening of the slot radiator and contacts a second side of the slot radiator.

14. The device according to claim 12, further comprising a tapered ridge that extends along an inner surface of the elongated waveguide, the tapered ridge comprising an arcuate surface that abuts the slot radiator and terminates against the inner surface of the elongated waveguide, the elongated waveguide extending past the tapered ridge.

15. The device according to claim 12, wherein the elongated waveguide has a polygonal cross sectional area.

16. The device according to claim 12, wherein the elongated waveguide has a cylindrical cross sectional area.

17. The device according to claim 1, further comprising another electrical feed, the another electrical feed being coupled to the dielectric substrate.

18. The device according to claim 1, wherein the antenna is a multi-stack set of antennas.

19. The device according to claim 1, wherein the antenna is at least one of an inverted F-antenna and planar inverted F-antenna.

20. The device according to claim 12, wherein the elongated waveguide comprises a first section, a second section, and a transition section disposed between the first section and the second section, the first section having at least one of a different cross-sectional cavity area and a different cross-sectional cavity shape than the second section.

* * * * *